United States Patent [19]

Yamazaki et al.

[11] Patent Number: 4,894,500

[45] Date of Patent: Jan. 16, 1990

[54] ROTARY SELECTOR SWITCH

[75] Inventors: Atsuo Yamazaki; Toshiaki Kaba, both of Iruma; Kenji Sakaguchi, Hanno, all of Japan

[73] Assignee: Copal Electronics Co., Ltd., Tokyo, Japan

[21] Appl. No.: 127,506

[22] Filed: Dec. 1, 1987

[51] Int. Cl.[4] ..... H01H 21/62

[52] U.S. Cl. ..... 200/565; 200/571; 200/308

[58] Field of Search ..... 200/336, 155 R, 155 A, 200/308, 291, 565, 548, 570, 571

[56] References Cited

U.S. PATENT DOCUMENTS

| | | | |
|---|---|---|---|
| 2,165,200 | 7/1939 | Batcheller | 200/565 |
| 2,478,690 | 8/1949 | Furnas et al. | 200/570 |
| 2,498,683 | 2/1950 | Hubell | 200/571 |
| 2,645,685 | 7/1953 | Neff | 200/571 |
| 2,970,199 | 1/1969 | Dull et al. | 200/569 |
| 3,174,002 | 3/1965 | Golbeck | 200/548 X |
| 3,731,016 | 5/1973 | Nadaguchi | 200/305 |
| 4,052,573 | 10/1977 | Kojima et al. | 200/11 DA |
| 4,082,925 | 4/1978 | Hufford | 200/565 X |
| 4,627,303 | 12/1986 | Hirose | 74/425 |

FOREIGN PATENT DOCUMENTS 62-139035 9/1987 Japan .

*Primary Examiner*—Renee S. Luebke

*Attorney, Agent, or Firm*—Wenderoth, Lind & Ponack

[57] ABSTRACT

A rotary selector switch having a wiper which is arranged on a rotor rotatably held in a cavity formed by a housing and case and is slidingly rotated on the housing base on which are disposed fixed contact elements, thereby to connect electrically at least one of the fixed contact elements to one of the remaining fixed contact elements, in which vertical walls of dovetail portions constituting a ridge projecting from the rotor base are arranged to abut in turn against side walls of ridges extended from an annular ledge arranged at an inner side of the housing corresponding to the rotation of the rotor whereby the rotation of the rotor is stopped; a slot defined in one of the dovetail portions of the ridge arranged on the rotor base is engaged in turn with one of the projections arranged on the housing base corresponding to the rotation of the rotor whereby an audible click may be caught; a slit defined in the housing base between the fixed contact elements disposed thereon aids to cut off a chain of undesirable powder bridging the fixed contact elements one of which is electrically connected to one of the remaining contact elements via the wiper.

2 Claims, 6 Drawing Sheets

ROTARY SELECTOR SWITCH

BACKGROUND OF THE INVENTION

The present invention relates to a rotary selector switch, and more specifically, to a miniature rotary selector switch assembly which is most suited for installation on a circuit board. Recently there has been a strong demand in the market for a miniature rotary selector switch of this sort.

A prior art rotary selector switch has a rotary rotatably held in a cavity formed by a housing and a case. With the rotation of the rotor, a wiper arranged on the rotor slidingly rotates on the housing base on which are disposed fixed contact elements, thereby to electrically connect at least one of the fixed contact elements to one of the remaining fixed contact elements.

The type of rotary selector switch assembly described above is in fact known and commercially available in the market. The known rotary selector switch assembly is provided with a rotor stopper means.

As shown in FIGS. 17 and 18, a rotor shaft (a) equipped with a rotor fitted therearound (not shown) has a ring (c) fitted therearound. The ring (c) is provided with an arm (b) projected radially outwardly therefrom, while a stopper base (e) embedded in a housing (d) underneath the ring (c) is provided with a plurality of holes, as shown by letters f1, f2 . . . into which desired pins (g) are fixedly inserted.

When the rotor shaft (a) is rotated together with the ring (c) in a clockwise or a counterclockwise direction by means of a handle (h), the projection (b) is slidingly rotated in the same direction and abuts against the stopper pins (g) whereby a further rotation of rotor shaft (a) is blocked.

The prior art rotor stopper means described above requires a complicated manufacturing procedure. This is a result of the complicated assembling of component parts including a rotor shaft, a ring having an arm, a stopper base and a plurality of holes defined in the base etc. Furthermore, an accurate stop position of the rotor shaft may not be obtained because of backlash created by the one way abutment of the projection against the stopper pin.

Since the miniature rotary selector switches are sealed units, the mechanism is not visible to an operator, who must, therefore, have some audible indication that the rotor is making a stepping rotation. Therefore, the prior art rotary selector switch is further provided with an audible indication means which yields an audible click whenever the rotor makes a stepping rotation. Such audible indication means is hereinafter referred to as a click mechanism.

A click mechanism used in the known rotary selector switch is as follows: A rotor comprised of plastic material housed in a cavity formed by a housing of plastic material and a case is provided with a rotor arm extended circumferentially and radially therearound and an end of the rotor arm is arranged to touch stepped portions disposed inside wall of the housing. As the rotor is rotated, as by the rotation of a screw driver or the like engaged in a slot defined in the upper surface thereof, the rotor arm is also rotated steppingly engaged with the stepped portions by turns so that the rotation angle of rotor may be recognized by looking at an arrow head associated with the slot which points to a scale arranged on the case or may be recognized by an audible click yielded by the sliding engagement between the stepped portion and the rotor arm.

The prior art click mechanism described above requires a complicated manufacturing procedure because of the inclusion of so many component parts of considerably large size with resultant difficulty of producing a thin rotary selector switch having a small physical size in order to meet a market demand as heretofore explained.

The prior art rotary selector switch referred to above has a wiper arranged on the rotor during the rotation of which the wiper rotates slidingly on the inner base of the housing on which are disposed fixed contact elements to electrically connect at least one of the fixed contact elements to one of the remaining fixed contacts.

The sliding rotation of the wiper as described above usually produces undesirable powder by dint of tear and wear of the wiper and the housing base due to friction therebetween. The powder thus produced is usually formed into a chain like a piece of yarn due to a frequent sweeping of the powder on the base by means of the rotating wiper.

When the wiper electrically connects at least one of the elements to one of the remaining contact elements as heretofore explained, the chain of powder sometimes spans some of the remaining unconnected contact elements and one of the contact elements already electrically connected via the wiper. This brings forth undesirable electrical leakage between the two contact elements with a result that the rotary selector switch may not achieve the expected efficiency.

BRIEF SUMMARY OF THE INVENTION

Accordingly, an essential object of this invention is to provide an improved rotary selector switch assemby which is designed to eliminate the disadvantages and inconveniences inherent in the prior art rotary selector switch assembly.

It is an object of this invention to provide a rotor stopper means of a rotary selector switch which has a simple structure and is of high quality and which can readily be manufactured without incurring any substantially increased manufacturing and labor costs.

Another object of the present invention is to provide an improved click mechanism of a rotary selector switch which can be readily manufactured economicaly and commercially without inclusion of component parts of considerably large size thereby facilitating a reduction in the physical size of a rotary selector switch.

A further object of this invention is to provide a means which prevents an undesirable electrical leakage between the contact elements by cutting off a chain of undesirable powder which is created by the wear and tear of the wiper and the housing base due to friction therebetween and is spanning the contact elements.

These objects of the present invention may be achieved by a rotary selector switch assembly provided with:

1. a rotor stopper means in which side walls of ridges projected from an annular wal of a housing abut against corresponding vertical walls of dovetail portion of ridges projecting from the rotor base respectively, corresponding to the rotation of the rotor thereby the rotor is stopped;

2. a click mechanism in which a slot defined in one of the dovetail portions of a ridge arranged on the rotor base is engaged with one of the projections arranged to project from an annular wall of a housing, corresponding to the rotation of thhe rotor whereby an audible click may be produced; or, 3. a click mechanism in which projections protruding from strips defined by slits disposed in a case around a rotor hole are designed to be engaged respectively with holes defined in the rotor corresponding to the rotation of the rotor, the engagement between the projection and the hole defined in the rotor bringing forth an audible click; and, 4. a means to prevent an undesirable electrical leakage between contact elements in which a slit arranged in the housing base between fixed contact elements acts to cut off a chain of undesirable dust bridging fixed contact elements while one of the fixed contact elements over which the dust is bridged is electrically connected via a wiper to one of the remaining contact elements.

Other objects and a further scope of applicability of the present invention will become apparent from the detailed description given hereinafter; it should be understood, however, that the detailed description and specific examples, while being of preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description of preferred embodiments thereof and with reference to the accompanying drawings in which.

DETAILED DESCRIPTION OF PREFERRED EMBODIMENT

The terminal leads of this invention are manufactured from a single plate of metallic material by any known method, for example, by means of a stamping or blanking technique.

Figure 6:
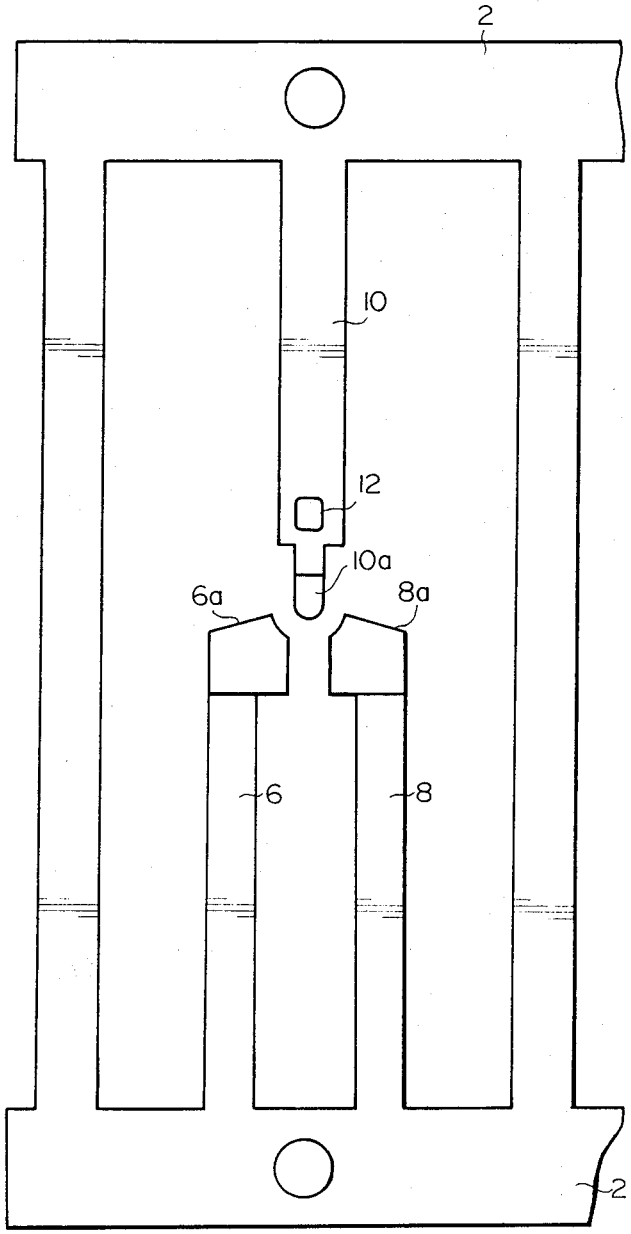
FIG. 6 is a plan view of terminal leads punched out of a metallic sheet.
Figure 7:
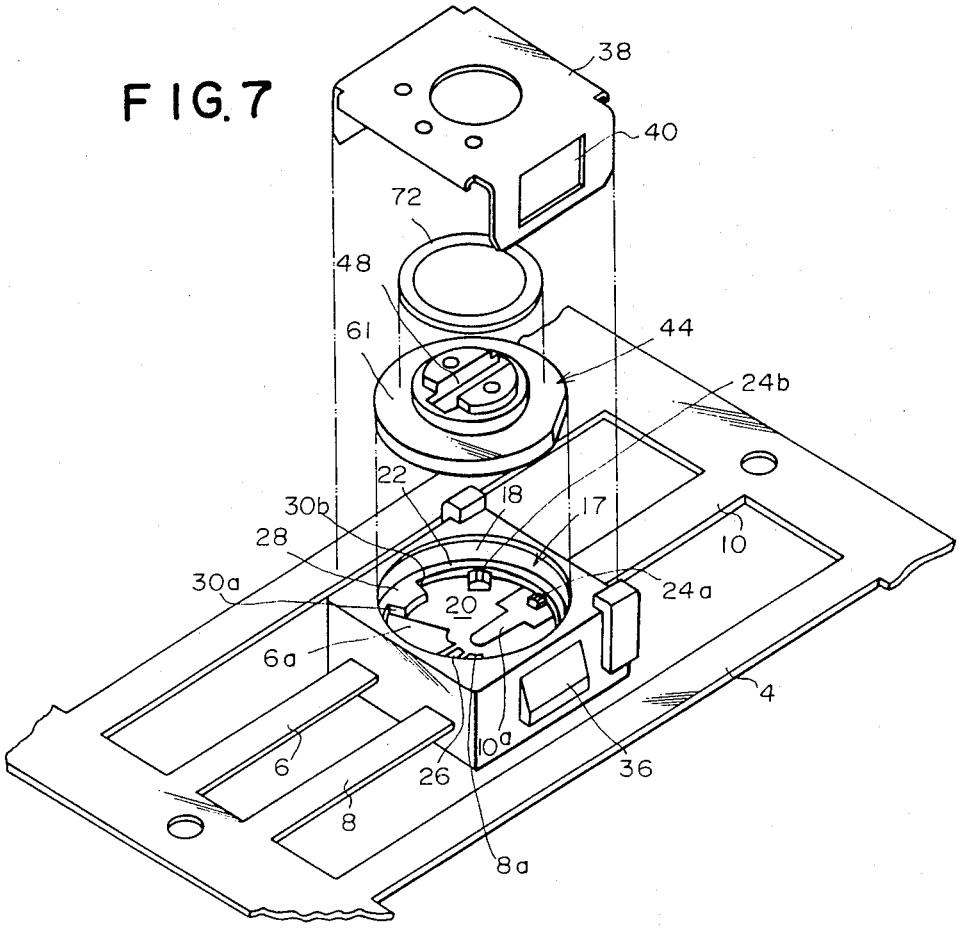
FIG. 7 is an exploded perspective view of a rotary selector switch of this invention.

Terminal leads 6, 8 and 10, as shown in FIG. 6, are punched out of a piece of a metal plate 2 which is preferably comprised of phosphor bronze.

Two output terminal leads 6 and 8 arranged in parallel extend from the one side of the metal plate 2. The fixed contact elements such as end portions 6*a* and 8*a* of output terminal leads 6 and 8 respectively are in spaced opposed relation to another fixed contact element such as an end portion 10*a* of the common terminal lead 10 which is extending from the other side of the metal plate 2. Thus these three end portions 6*a*, 8*a* and 10*a* of terminal leads 6, 8 and 10 are arranged in positions corresponding to the apexes of a triangle.

The end portions 6*a*, 8*a* and 10*a* of the terminal leads 6, 8 and 10 are solder plated by any well-known soldering technique.

Figure 1:
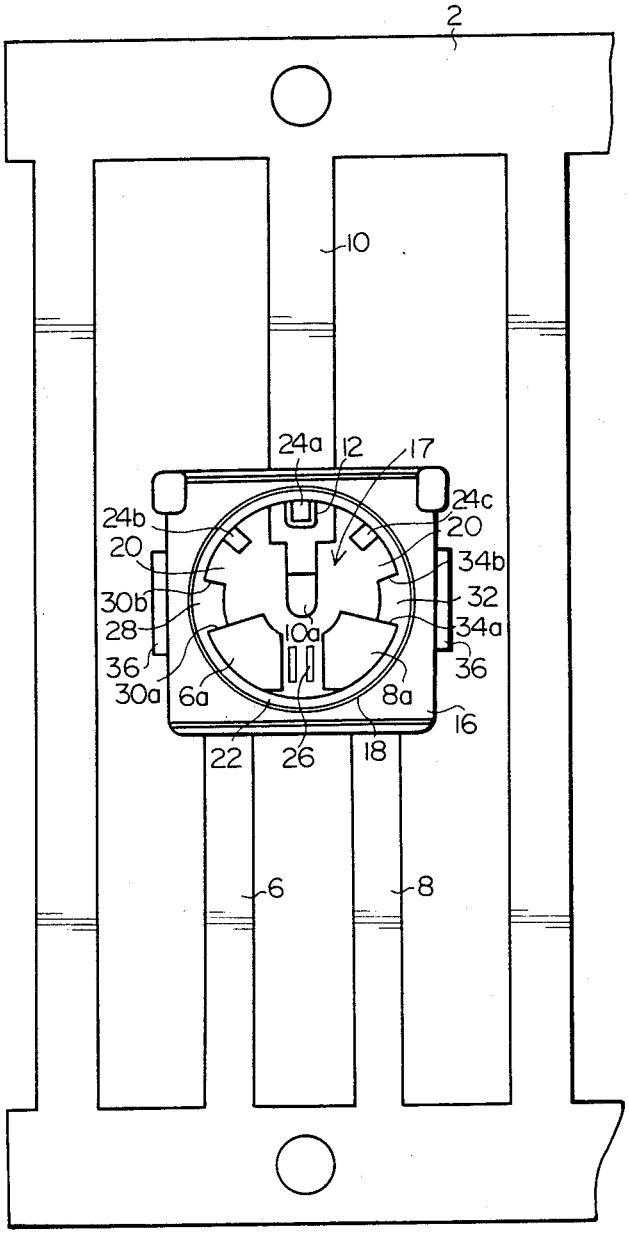
FIG. 1 is a top plan view of a rotary selector switch according to the present invention with terminal leads being uncut and with a case and a rotor being removed.
Figure 2:
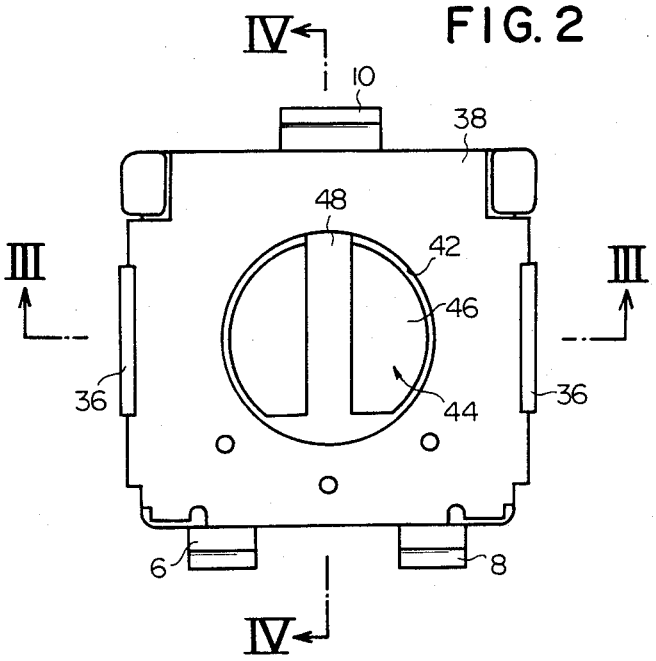
FIG. 2 is an enlarged top plan view of a rotary selector switch according to the present invention.

As shown in FIG. 1, a housing 16 which is preferably of a molded plastic material is provided with a chamber 17 defined by a circumferential wall 18 and a base 20. A rotor 44 which will hereinafter be explained in detail is rotatably held in the chamber 17 supported by an annular ledge 22 projecting inwardly from the circumferential wall 18 of the housing 16.

The terminal lead end portions 6*a*, 8*a* and 10*a* are respectively disposed on the base 20. The may constitute fixed contact elements 6*a*, 8*a* and 10*a*.

Three projections 24*a*, 24*b* and 24*c* are arranged to project from the annular wall 22 with an equal space therebetween. The projection 24*a* protrudes through a hole 12 defined in the terminal lead 10. These projections may constitute component parts of a click mechanism as will hereinafter be described.

A pair of ridges 28 and 32 are arranged to project inwardly from the annular ledge 22 of the housing 16. The ridge 28 is provided with two side walls 30*a* and 30*b*, the wall 30*a* being disposed adjacent to the end portion 6*a* of output terminal lead 6. The ridge 32 is also provided with two side walls 34*a* and 34*b*, the wall 34*a* being disposed adjacent to the end portion 8*a* of output terminal lead 8. These ridges 28 and 32 constitute component parts of a rotor stopper means as will hereinafter be explained.

At least one or more slits 26 are defined in the base 20 between the end portions 6*a* and 8*a* of the output terminal leads 6 and 8 respectively. These slits 26, as will hereinafter be described, constitute component parts of a means which aids to eliminate an undesirable electrical connection between the fixed contact elements such as terminal end portions 6*a* and 8*a* by cutting off a chain of undesirable powder which is created by the wear and tear of a sliding wiper 50 and a housing base 20 due to friction therebetween and bridges the fixed contact elements 6*a* and 8*a*.

A case or cover 38 is assembled with the housing 16 with projections 36 on housing being slidably snapped into holes 40 defined in a pair of bent legs 39 of the case 38 when the case 38 is pushed down upon the housing 16. The case 38 is also provided with a hole 42 which receives a head 46 of the rotor 44. When the case 38 is assembled with the housing 16, the rotor 44 is held in the chamber 17 thereof with a rotor base 61 being rotatably supported by the annular ledge 22 and with a rotor head 46 being also rotatably housed in the hole 42 defined in the case 38. A slot 48 is arranged in the center of the rotor head 46. By the rotation of a screw driver or the like which is applied in the slot 48, the rotor 44 is rotated in a predetermined direction.

Needless to say, the individual terminal leads 6, 8 and 10 are formed by cutting of the edge of the metal plate so as to have a predetermined length.

Figure 5:
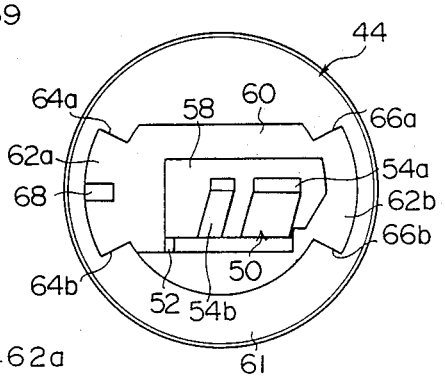
FIG. 5 is an enlarged bottom plan view of a rotor according to this invention.

In FIG. 5, a groove 58 extends into the rotor 44 and accommodates a wiper 50 which has a foot 54 comprised of brush wires 54*a* and 54*b* slantedly arranged and held in a slit 52. Whenever the wiper 50 rotates with the rotor 44, the brush wires 54*a* and 54*b* electrically connect the terminal leads 6 or 8 to 10 respectively by bridging the fixed contact elements such as terminal end portions 6*a* and 10*a* or 8*a* and 10*a* respectively.

The groove 58 is surrounded with a ridge 60 projecting from the rotor base 61. The ridge 60 is provided with a pair of dovetail portions 62*a* and 62*b*. The dovetail portion 62*a* has vertical walls 64*a* and 64*b* while the other dovetail portion 62*b* has vertical walls 66*a* and 66*b*. A slot 68 is defined in the center of dovetail portion 62*a*. The slot 68 is arranged to be engageable or disengageable in turn with the projections 24*b*, 24*a* and 24*c* arranged to project from the annular ledge 22 whenever the rotor 44 is rotated within the chamber 17 of the housing 16.

Figure 3:
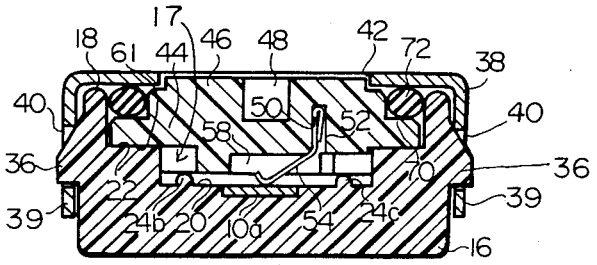
FIG. 3 is a sectional view of FIG. 2 taken along line III—III.
Figure 4:
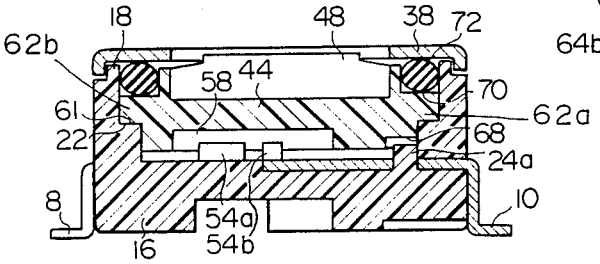
FIG. 4 is a sectional view of FIG. 2, substantially along line IV—IV.

FIGS. 3 and 4 are sectional views of the rotary selector switch wherein the rotor 44 is rotatably housed in the housing chamber 17. A resilient O-ring 72 is located in a recess 70 of the rotor 44 so as to prevent undesirable material such as dust or grease from passing inwardly toward the upper surface of the base 20 and to obtain a smooth rotation of the rotor 44 within the chamber 17.

The operation of the rotary selector switch of this invention will be desribed hereunder.

By rotating a screw driver or the like applied to the slot 48 arranged in the rotor head 46 in a clockwise or a counterclockwise direction, the rotor 44 which is held in the housing chamber 17 is rotated in the corresponding direction, whereby the brush wires 54*a* and 54*b* of the wiper foot 54 slide on the housing base 20.

As shown in FIG. 4, before the start of the rotation of the rotor 44, the slot 68 defined in the dovetail portion 62*a* of the projected ridge 60 is in engagement with the projection 24*a* protruding from the annular ledge 22 through the hole 12. But as soon as the rotor 44 is rotated in a counterclockwise direction (in FIG. 1), for example, the dovetail portion 62*a* is rotated in the same direction whereby the engagement of slot 68 defined in the dovetail portion 62*a* with the projection 24*a* is released and with further rotation the slot 68 engages eventually with another projection 24*b*. When the slot 68 is engaged with the projection 24*b*, and audible click is heard by the operator.

The resiliency of the O-ring 72 disposed between the case 38 and the rotor 44 may help the smooth engagement or disengagement described above. Thus the stepping rotation of the rotor 44 may be recognized by an operator who will hear an audible click.

Simultaneously with the rotation of the rotor 44, the vertical wall 64*a* of the dovetail projection 62*a* of the ridge 60 arranged on the rotor base 61 abuts against the side wall 30*b* of the ridge 28 projected from the annular ledge 22 while the vertical wall 66*b* of the dovetail portion 62*b* of the ridge 60 arranged on the rotor base 61 also abuts against the side wall 34*a* of the ridge 32 projected from the annular ledge 22 to thereby stop the rotation of the rotor 44 wherein the brush wire 54*b* of the wiper foot 54 contacts the end portion 10*a* of the common terminal lead 10 while the brush wire 54*a* of the wiper foot 54 also contacts the end portion 8*a* of the output terminal lead 8 with resultant electrical connection between the common terminal 10 and the output terminal lead 8.

When the rotor 44 is rotated in a clockwise direction, the slot 68 which is in engagement with the projection 24*a* is shifted to be engaged with the other projection 24*b* after being released from the engagement with the projection 24*a*. And with the rotation of the rotor 44 in the same direction the vertical wall 66*a* of the dovetail portion 62*b* abuts against the side wall 30*a* of the ridge 28 of the housing 16, while the vertical wall 64*b* of the dovetail portion 62*a* of the ridge 60 arranged on the rotor base 61, against the side wall 34*b* of the ridge 32 of the housing 16.

Simultaneously an electrical connection between the common terminal 10 and the output terminal lead 6 is obtained via the wiper foot 50 bridging over the end portion 6*a* of the output terminal 6 and the end portion 10*a* of the common terminal lead 10.

In this embodiment, the rotation angle of the rotor 44 is set at 45°. However any desired angle may be adopted to meet the demand.

Whenever the rotor 44 held in the housing chamber 17 is rotated in a clockwise or a counterclockwise direction and the brush wires 54*a*, 54*b* of the wiper foot 54 arranged on the rotor 44 slide on the housing base 20 and on the fixed contact elements such as end portions 6*a*, 8*a* and 10*a* of the output terminal leads 6, 8 and the common terminal lead 10 respectively, undesirable material such as powder or dust is created by dint of friction between the rotating brush wires 54*a*, 54*b* of the wiper foot 54 and the housing base 20 on which the end terminal lead portions 6*a*, 8*a* and 10*a* are disposed, as explained heretofore. The undesirable material may also be created by engagements or disengagements between the slot 68 and the projections 24*a*, 24*b* and 24*c* respectively as heretofore explained. The undesirable material such as powder or dust tends to spread within the housing chamber 17 but by dint of sweeping movement of the wiper foot 54, the powder or dust may be formed into a chain like a piece of yarn. The yarn may cause an undesirable electrical leakage between the terminal leads as will be explained hereinafter. For example, the brush wires 54*a* and 54*b* of the wiper foot 54 bridge the end portion 10*a* of the common terminal lead 10 and the end portion 6*a* of the output terminal lead 6 to thereby connect electrically the output terminal 6 and the common terminal lead 10 as heretofore explained.

However, if a chain of undesirable dust bridges the end portion 6*a* and 8*a* of the output terminal leads 6 and 8 while the terminal leads 6 and 10 are thus connected, an electrical leakage between the two terminal leads 6 and 8 may be developed.

A slit 26 defined in the housing base 20 between the terminal lead end portion 6*a* and 8*a* aids to cut off the chain of undesirable dust to thereby prevent the development of electrical leakage therebeteween.

In this embodiment, a pair of slits 26 are defined in parallel in the housing base 20 between the two terminal lead end portions 6*a* and 8*a*. However, the number of slits 26 may be reduced or increased depending upon the design of a rotary selector switch to be adopted.

Figure 8:
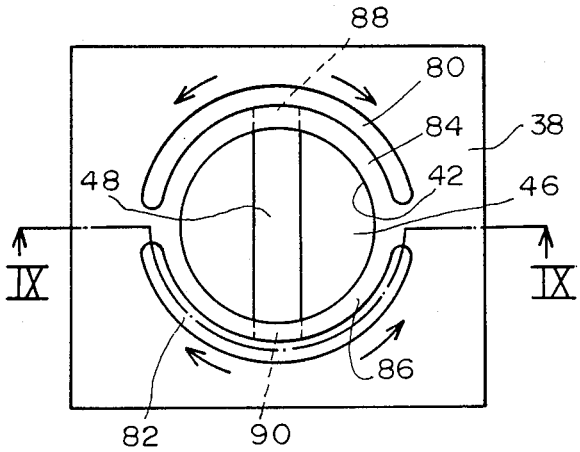
FIG. 8 is a top plan view of a rotary selector switch having another embodiment of a click mechanism.
Figure 9:
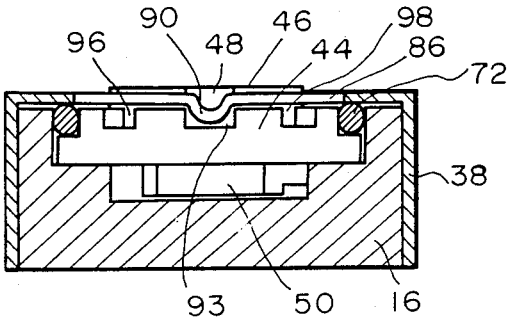
FIG. 9 is a sectional view of FIG. 7 taken along line IX—IX.

Another embodiment of click mechanism of this invention will be explained referring to FIGS. 8 and 9.

A case 38 comprised of resilient metal is provided with a pair of semicircumferential slits 80 and 82 arranged around the rotor hole 42 thereof. A pair of semicircumferential resilient strips 84 and 86 are formed between the hole 42 and the semicircumferential slits 80 and 82 respectively. The semicircumferential resilient strips 84 and 86 are provided with projections 88 and 90 respectively protruding downwardly from the center thereof. The projections 88 and 90 are engaged with recesses 91 and 93 defined in the rotor 44 at both ends of the slot 48 of the rotor head 46 respectively, as shown in FIGS. 8 and 9.

Figure 10:
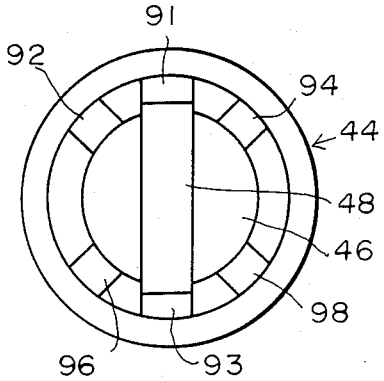
FIG. 10 is a plan view of a rotor in which holes for a click mechanism are defined.
Figure 11:
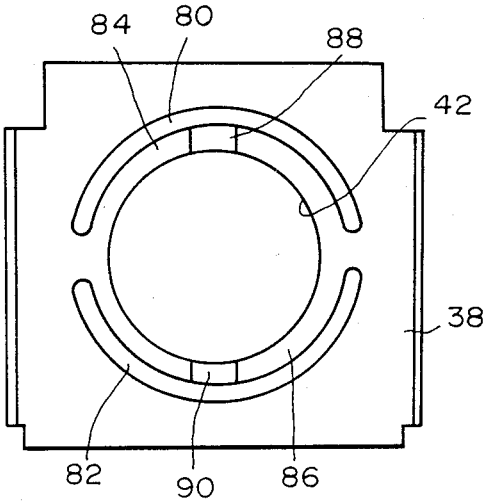
FIG. 11 is a bottom plan view of a case showing projections for a click mechanism.

Two pairs of recesses 92, 94 and 96, 98, as shown in FIG. 10, are defined in the rotor 44 in addition to the recesses 91 and 93 as heretofore explained. Each pair of recesses 92, 94 and 96, 98 are located symmetrically or equally spaced from the center of the rotor slot 48. These recesses 92, 94 and 96, 98 together with the recesses 91, 93 are engageable or disengageable with the projections 88 and 90 respectively, as will hereinafter be explained. When the rotor 44, as shown in FIG. 8, is rotated in a clockwise direction by applying a screw driver or the like in the slot 48 thereof, the projections 88 and 90 which are pre-engaged with the recesses 91 and 93 respectively are rotated in the same direction whereby the projection 88 becomes engaged with the recess 94 after being disengaged from the recess 91 defined in the rotor 44 while the projection 90 is engaged with the recess 96 after being disengaged from the recess 93 defined in the rotor 44. And when the rotor 44, as shown in FIG. 8, is rotated in a reverse direction, the projection 88 which is already engaged with the recess 91 is rotated to be engaged with the recess 92 after being disengaged from the recess 91 while the projection 90 becomes engaged from the recess 98 after being disengaged with the recess 93.

The engagement or disengagement thus explained may be performed efficiently by means of the resiliency of the semicircumferential strips 84 and 86 coupled with the resilient O-ring 72. When the projections 88 and 90 are thus engaged with the recesses 92, 94 and 98 in turn, an operator who rotates the rotor 44 will be able to hear an audible click and will be able to recognize stepped rotations of the rotor 44.

Figure 13:
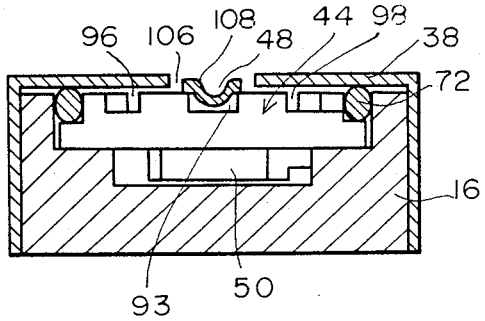
FIG. 13 is a sectional view of FIG. 12 taken along line XIII—XIII.
Figure 12:
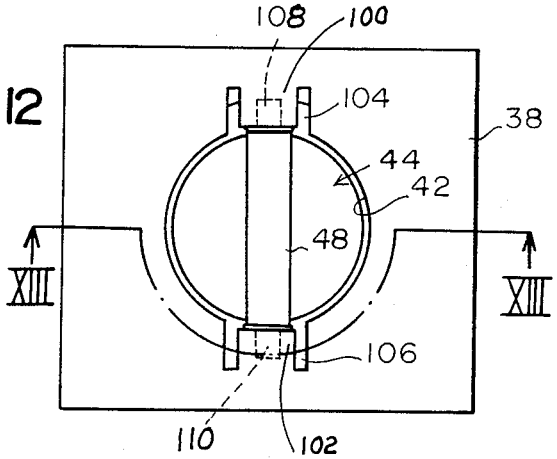
FIG. 12 is a top plan view of a rotary selector switch equipped with a further embodiment of a click mechanism.
Figure 14:
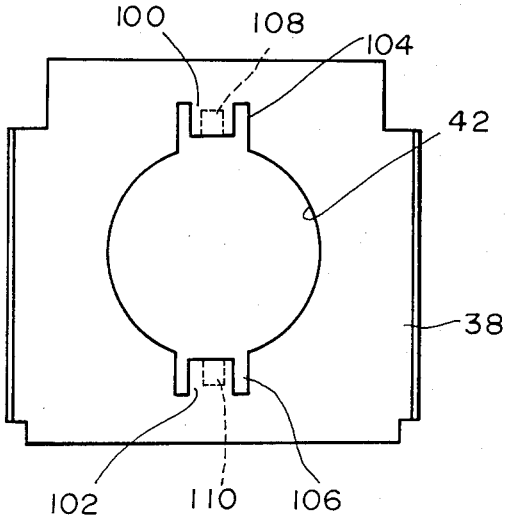
FIG. 14 is a bottom plan view of a case shown in FIG. 12.

Another embodiment of a click mechanism is illustrated in FIGS. 12 and 13 in which the semicircumferential resilient strips 84 and 86 heretofore explained are replaced by tongue-shaped resilient strips 100 and 102 which are defined in the case around the rotor hole 42 and encompassed by slits 104 and 106 respectively are provided with projections 108 and 110 underneath thereof, as shown in FIG. 14.

Figure 15:
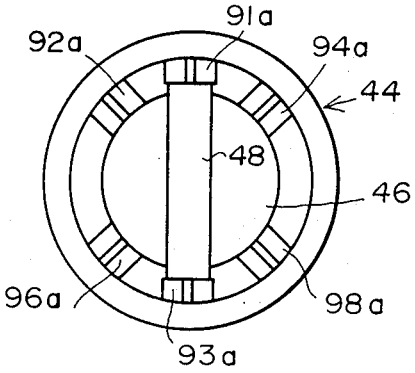
FIG. 15 is a bottom plan view of a rotor provided with V-shaped holes.
Figure 16:
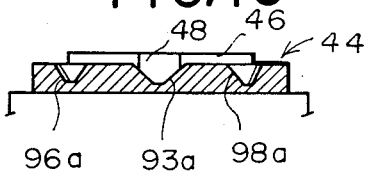
FIG. 16 is a sectional view of a rotor equipped with V-shaped holes.
Figure 17:
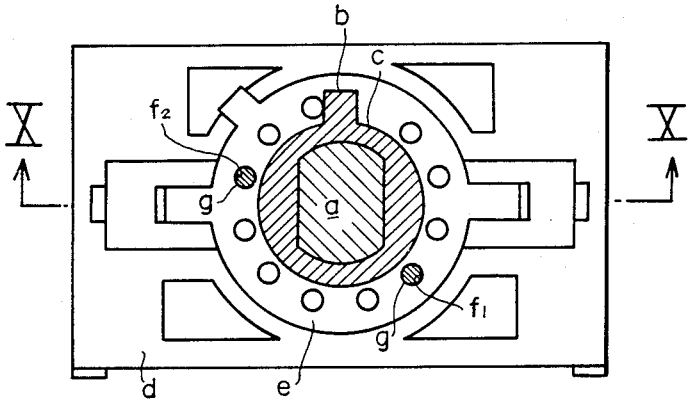
FIG.17(PRIOR ART)
FIG. 17 is a plan view of a rotary selector switch of the prior art with a shaft and a ring being in section.
Figure 18:
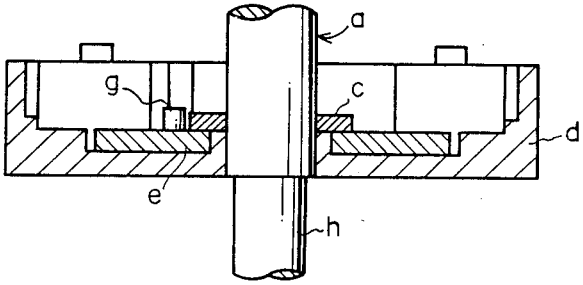
FIG.18 (PRIOR ART)
FIG. 18 is a side elevation view of FIG. 17.

Another embodiment of recesses defined in the rotor 44 is illustrated in FIGS. 15 and 16.

A plurality of recesses 91*a*, 92*a*, 93*a*, 94*a*, 96*a* and 98*a* in section are defined in the rotor 44. The configuration of the recess aids a smooth engagement or disengagement of the projections 88 and 90 projected from the circumferential resilient strips 84 and 86 with these V-shaped recesses described above.

What we claim is:

1. In a rotary selector switch having a wiper means on a rotor which is rotatably mounted in a cavity in a housing and having a cover holding the rotor in the cavity, the rotor being rotatable in the cavity for causing the wiper means to contact fixed contact elements on said housing to connect electrically at least one of the fixed contact elements with one of the remaining fixed contact elements, the improvement comprising, in combination:

a rotor stopper means comprising a pair of ridges extending inwardly from said housing into said cavity, each ridge having opposite circumferentially spaced side walls, and a further ridge projecting from said rotor into said cavity and which has a pair of dovetail portions on radially opposite ends thereof each of which has circumferentially spaced vertical walls, the side walls of said ridges being abutted by corresponding vertical walls of the dovetail portions of said further ridge upon the rotation of the rotor in clockwise or counterclockwise direction for stopping the rotation of the rotor, and a click mechanism for providing an audible sound to an operator comprising projections projecting from said housing into said cavity at equally spaced circumferential positions, one of the contact elements being disposed on the bottom of said cavity and having a hole therethrough and one of the projections protruding through said hole, one of the dovetail portions of said further ridge having a slot in the radially outer end thereof engageable with the projections during rotation of the rotor for producing an audible click.

2. A rotary selector switch having a wiper means on a rotor which is rotatably mounted in a cavity in a housing and having a cover holding the rotor in the cavity, said rotor being rotatable in the cavity for causing the wiper means to contact fixed contact elements on said housing to connect electrically at least one of the fixed contact elements with one of the remaining fixed contact elements, said cover having a central aperture therein and a plurality of pairs of spaced parallel slots extending outwardly from said central aperture to define resilient strips, said rotor having recesses therein spaced around the circumference thereof, the inner ends of said resilient strips having click projections thereon engagable in said recesses for producing an audible click to an operator of said rotary selector switch.

* * * * *